United States Patent [19]

Cheng

[11] 4,211,734

[45] Jul. 8, 1980

[54] AUTOMOTIVE ANTI-CHOKING DEVICE

[76] Inventor: Sheng-Hsiung Cheng, P.O. Box 17092, West Hartford, Conn. 06117

[21] Appl. No.: 13,562

[22] Filed: Feb. 21, 1979

[51] Int. Cl.[2] ..... F02M 1/10

[52] U.S. Cl. ..... 261/39 B; 248/226.3; 248/226.2

[58] Field of Search ..... 261/39 B; 123/119 F; 400/298, 295.1, 295.2; 248/37.3, 226.3, 226.2, 37.6; 251/264

[56] References Cited

U.S. PATENT DOCUMENTS

| | | | |
|---|---|---|---|
| 115,794 | 6/1871 | Walsh | 251/264 |
| 556,239 | 3/1896 | Ashald et al. | 248/226.3 |
| 977,271 | 11/1910 | Callaghan | 251/264 |
| 1,106,295 | 8/1914 | Gail | 251/264 |
| 1,371,319 | 3/1921 | Manlond | 248/37.3 |
| 1,953,828 | 4/1934 | Johnson | 251/264 |
| 2,867,402 | 1/1959 | Graybill et al. | 248/226.3 |
| 2,906,124 | 9/1959 | Chaney | 248/37.6 |
| 3,726,511 | 4/1973 | Jones | 261/39 B |
| 3,944,178 | 3/1976 | Greenwood | 248/226.3 |

*Primary Examiner*—Tim R. Miles

[57] ABSTRACT

An automotive accessory for preventing a carburetor choke plate from completely sealing the air passage and making a hard starting in cold weather; the accessory including a clamp mounted around an end of the carburetor air intake pipe, and the clamp supporting an adjustable hook positioned to extend around one end of the pivoted choke plate so to limit its pivotal travel toward a closing position.

1 Claim, 4 Drawing Figures

10
11
12
13
14
15
16
17
18
19
20
21
22
23
24
25
26
27
28
29
30
31
32

AUTOMOTIVE ANTI-CHOKING DEVICE

This invention relates generally to automotive accessories.

It is well known to most motorists living in colder climates that sometimes it is difficult to start up the vehicle engine when weather temperature drops below freezing, and which is usually due to the choke plate becoming sealed.

A principal object of the present invention is to accordingly provide an anti-choking device that prevents a carburetor choke plate from completely sealing the air passage and resulting in a hard start of the engine.

Other objects are to provide an automotive anti-choking device which (1) helps reduce engine warm-up time in the morning, (2) prevents a car stalling on a highway due to a cold engine, (3) eliminates wasting time and gasoline used to restart a stalled car, (4) improves engine performance, particularly in cars that are no longer new, so to get better gas mileage ratio, and (5) does not increase air pollution.

Still other objects are to provide an anti-choking device which is inexpensive and easy to install.

Further other objects will be readily evident upon a study of the following specification and the accompanying drawing, wherein.

Figures 1, 2, 3, 4:
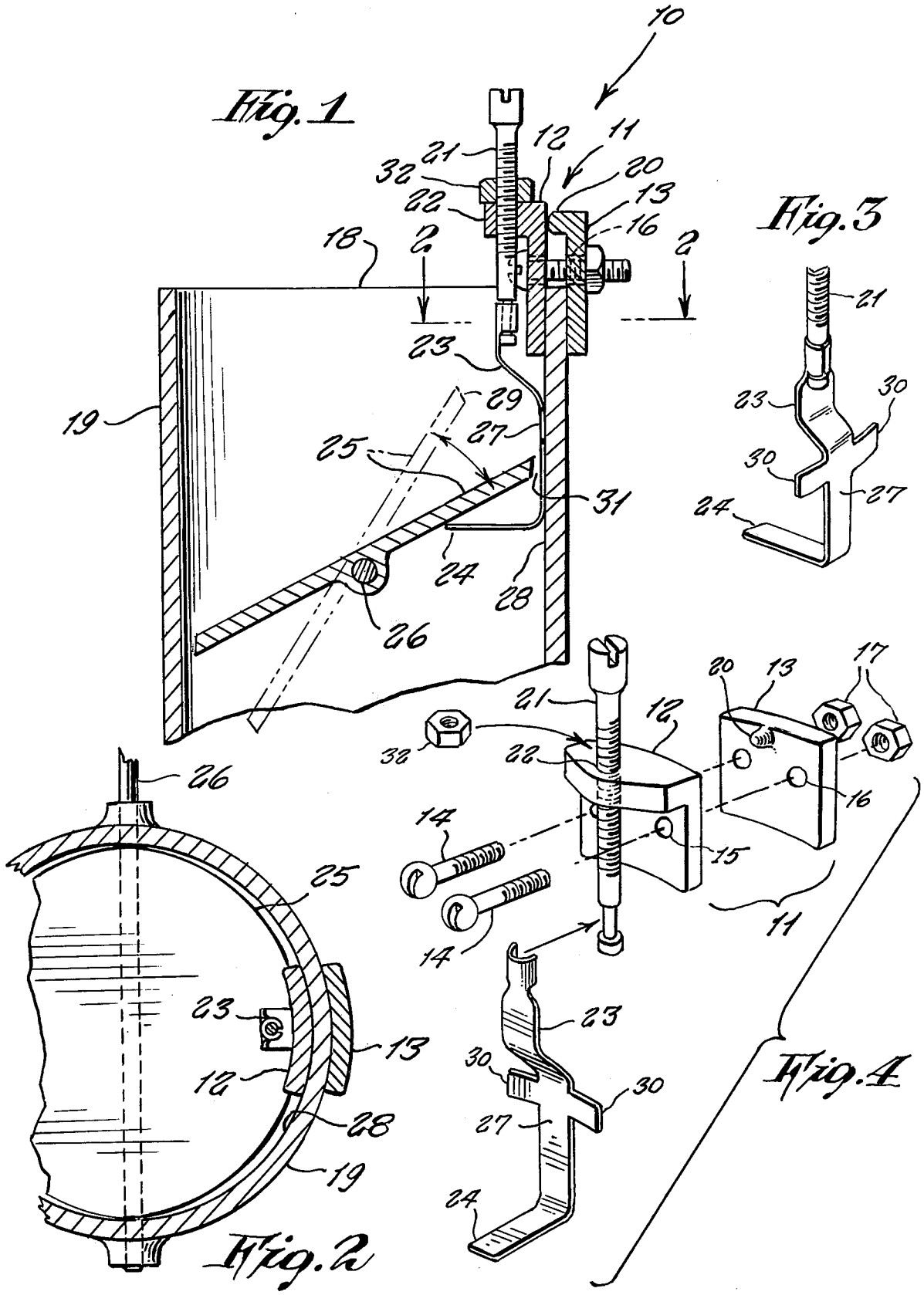
FIG. 1 is a side cross-sectional view of the invention shown installed on a carburetor.
FIG. 2 is a cross-sectional view on line 2—2 of FIG. 1.
FIG. 3 is an enlarged detail, perspective view of the hook component thereof, shown swivelled on the screw.
FIG. 4 is an exploded perspective view of the invention components.

Referring now to the invention in greater detail, the reference numeral 10 represents an automotive anti-choking device according to the present invention, wherein there is a clamp 11 comprised of jaws 12 and 13 held together by screws 14 passed through holes 15 and 16 and secured by nuts 17. The clamp is fitted around an edge 18 of air intake pipe 19 of the carburetor. A bump

20 is made on one end of jaw 13 so to maintain the jaws parallel.

A screw 21, in a threaded opening 22 of jaw 12, is attached rotatably free to a hook member 23 made from stiff, flat steel, which at one end is bent at right angle to form a hook-shaped stop 24 that abutts against an underside of a butterfly flap valve or choke plate 25 of the carburetor pivoted about pin 26. An intermediate portion 27 of member 23 is bent to rest against an inner side face 28 of the pipe 19 in order to clear an end edge 29 of the choke plate as much as possible so as to not interfere with the choke plate travel. Sideward wings 30 on the intermediate portion also rest against the pipe inner face and serve to prevent rotation of the member 23 while the screw 21 is turned.

In operative use, the width of a minimum gap 31 between the choke plate edge 29 and pipe face 28 is controlled by simply turning the screw 21, thereby raising or lowering the stop 24. A nut 32 rigidly secures the screw in selected position. Thus the device serves to maintain a minimum sized air gap that is constantly open, regardless of temperature changes in the engine. While an air gap is set when the car is manufactured, this gap tends to close up, after a period of use, resulting in the hard engine start, so the present device resolves this situation.

It is understood that such changes may be made in the construction, as wished, provided that they are within the scope of the appended claims.

I claim:

1. An automotive anti-choking device, comprising in combination, a clamp securable to a carburetor air intake pipe, a rotatable screw supported on said clamp, and stop means on said screw for abutting against one side of a pivotable chokeplate of said carburetor, so to limit pivotal travel thereof; said stop means comprising a thin strip of flat stiff steel secured rotatably free on said screw and which extends around an end edge of said chokeplate, and which is hook-shaped at its end to form a stop for said chokeplate, and a pair of oppositely extending, sideward wings on said strip for resting against an inner side of said pipe and prevent rotation of said strip; and said clamp comprising a pair of jaws adjustably held together by screws.

* * * * *